US005511718A

United States Patent [19]

Lowder et al.

[11] Patent Number: 5,511,718

[45] Date of Patent: Apr. 30, 1996

[54] PROCESS FOR MAKING MONOLAYER SUPERABRASIVE TOOLS

[75] Inventors: James T. Lowder, Columbus; Robert W. Evans, Worthington, both of Ohio

[73] Assignee: Abrasive Technology, Inc., Westerville, Ohio

[21] Appl. No.: 334,671

[22] Filed: Nov. 4, 1994

[51] Int. Cl.[6] ..... B23K 1/20

[52] U.S. Cl. ..... 228/103; 228/248.1

[58] Field of Search ..... 228/103, 248.1

[56] References Cited

U.S. PATENT DOCUMENTS

| | | | |
|---|---|---|---|
| 3,891,408 | 6/1975 | Rowse et al. | 51/295 |
| 5,213,591 | 5/1993 | Celikkaya et al. | 51/293 |

*Primary Examiner*—Kenneth J. Ramsey
*Attorney, Agent, or Firm*—Francis T. Kremblas, Jr.

[57] ABSTRACT

A process of making brazed monolayer abrasive tools wherein the braze alloy and abrasive particles are applied to the tool form and the weight of each material is monitored after each application step to determine the weight of each of these materials which is applied to the tool form to more precisely control the bond height and diamond concentration in the finished tool product. The weight of each material applied to the tool is compared to a predetermined target weight after the individual steps of applying the material. If the amount of either material applied to the tool falls outside selected limits of the weight target, the tool assembly may be rejected at that stage of the process. Only tools which successfully pass the comparison step are further processed and introduced to the fusion for step braze bonding the alloy and abrasive particles to the tool. This permits the tool components from rejected tools to be recovered and recycled if desired. Also disclosed is a method of using this weight monitoring process to fabricate tools having a known range of amounts of alloy and abrasive particles applied and testing the same to determine the most desirable weight target to be used as related to improved tool performance. The weight monitoring information may also be used in a manner which aids the fabricating personnel to achieve a higher degree of consistency in the amount of braze alloy and abrasive particles applied to the tool form.

3 Claims, No Drawings

PROCESS FOR MAKING MONOLAYER SUPERABRASIVE TOOLS

TECHNICAL FIELD

The present invention relates generally to a method of fabricating a brazed bonded abrasive tool and particularly to an improved method for making such tools by more precisely controlling the bond depth, concentration of abrasive particles, and the exposure of the abrasive particles.

BACKGROUND ART

Monolayer tooling has become an increasingly important construction form for superabrasives, e.g., diamond and cubic boron nitride, replacing the traditional metal, vitreous and resin bonded multi-layered products in many applications and creating entirely new applications for superabrasive material removal. Historically, the principal method of construction of superabrasive monolayer tools was, up until the early 1970's, entrapment electroplating with nickel on a steel or otherwise suitable metallic form. In 1975, a patent was issued to J. T. Lowder et al. for a process of brazing diamond to create mono-layer tools with a nickel-chromium-boron alloy. Other brazing processes had been previously described and used in the manufacture of monolayer abrasive tools. The process invented by Lowder et al. provided an extremely strong, abrasion resistant bond and was commercialized so successfully that it became the principal bonding method for mono-layer diamond abrasive tools in numerous applications and a major competitive method to entrapment nickel plating which previously dominated monolayer abrasive tooling.

Manufacturers of mono-layer abrasive tools have devised various methods for applying the braze alloy and abrasive particles and attempting to control the exposure of the abrasive grains above the bonding layer. The most common quality control method is a simple visual inspection of the finished product at some low magnification, e.g. 5–40×. In most instances, a manual inspection against visual standards has been thought to be the most effective technique from both a cost and quality standpoint. Although techniques of topographical mapping and measurement have emerged which would provide precise information regarding abrasive concentration, bond height and abrasive exposure, the expense of such techniques have remained a deterrent to their employment. Not only is there significant capital investment, but the speed of analysis is prohibitively slow with even the best of the advanced topographical scanning systems. Thus, the state of the art in control of abrasive concentration and bond height in monolayer superabrasive tooling is visual inspection of the finished product. Products which fail to meet the visual standard are simply discarded with an accompanying loss of the tool mandrel used in small tools, such as dental drills, and loss of the diamond abrasive particles.

Prior to the present invention, those skilled in the art have failed to provide a method controlling these factors in a practical economic manner.

BRIEF DISCLOSURE OF INVENTION

The present invention relates generally to the making of abrasive tools and particularly to a method of braze bonding a monolayer of abrasive particles to a tool substrate in a manner which affords improved control of bond depth, abrasive concentration, and exposure of the abrasive particles on the tool substrate.

The method of construction of the brazed diamond dental instrument as practiced with the alloy bond described in U.S. Pat. Nos. 3,894,673 and 4,018,576 has made it possible to develop an effective means for securely bonding a monolayer of diamond particles to a tool substrate.

Generally the construction techniques practiced in the brazing of diamond to a mandrel or blank form involve sequentially coating the blank form with a uniform layer of the alloy in particulate or powder form followed by application of a uniformly distributed layer of the diamond abrasive, utilizing a temporary binder from one of any number of other suitable organic binders well-known to those skilled in the art which will generally vaporize during the subsequent fusion of the alloy. The alloy may be in a paste with the binder or the binder may be applied and then the alloy adhered by dipping into a loose bed or sprinkling. Likewise the diamond may be applied to the alloy coated blank form by the aid of another binder. The order may be reversed in some instances such that the diamond may be first adhered to the blank form and the alloy applied to advantage in a subsequent step. Using either construction method, it has been discovered that both alloy and diamond can be applied in very precise amounts by tare weight inspection of each application step. With weight monitoring, it has been found that individuals using manual techniques to apply the braze and diamond can become very consistent in the quantities applied and applications falling outside established target limits can be recycled in the assembly process before committing the tool assembly to the fusion step. With this level of control, it has been possible to survey diamond and bond levels to determine that indeed very significant performance variation results from seemingly insignificant variations in the amount of alloy and diamond applied to the tool substrate.

In essence, the present invention comprises a method of making monolayer abrasive tools wherein the weight of the bonding alloy particles and the abrasive particles applied to the tool substrate is determined and compared to a selected target weight after each respective application step to the target form. Those tool assemblies which are not within selected limits of an established weight target are rejected prior to the fusion step in the brazing process, while those meeting the standard are further processed to completion.

The weight target is selected upon the basis of testing which involves checking a range of weights of the alloy and diamond particles actually applied to tool forms and testing the finished tool's performance to arrive at the particular weight standard of alloy and diamond which is related to the performance characteristics desired for the particular tool involved. Once this target has been selected, it may be used to compare against the weight of the alloy and diamond applied to tool substrates in the manufacturing of the tools according to the present invention to provide tools possessing dramatically more consistent performance characteristics. Further, a cost saving may be realized in the recovery of expensive tool substrates, alloy and abrasive particles for those tools rejected for failure to meet either the alloy or abrasive weight standard established for a given tool.

The selection of the mode of performance testing to establish the particular target or weight standard for the alloy and diamond materials applied to the tool is within the choice of one skilled and knowledgeable in the art of monolayer superabrasive tools. There has been much discussion and non-universal agreement over performance testing standards to be used for certain abrasive tools. However, using any of the generally acknowledged methods would lead one to important information and insight to select a weight standard by using the method of the present invention to produce a number of tools made with known weight variations and survey the performances of these tools. The knowledge gained in accordance with the present invention that relatively small differences, heretofore considered as insignificant, in the amount of alloy and diamond applied to the tool in the fabricating process cause very significant differences in durability and cutting rates, may be used to select target weights which tend to provide tools exhibiting the more desirable performance characteristics on a dramatically more consistent basis than prior control methods using solely visual inspection. While the selection of the target or weight standard for the alloy and diamond particles may be a matter of subjective judgment to some degree, preferably one would tend to select a weight standard which performance testing indicates improving the more desirable characteristics for a given application.

The discovery that differences in the amount of alloy particles and diamond applied, which are not detectable using visual quality control inspection, indeed lead to very significant differences in the performance characteristic of such tools is very surprising to those skilled in the art.

The combination of the techniques described above provides one with the capability of surveying the effects of more precisely varying the amounts of diamond and bonding alloy in a monolayer diamond abrasive instrument and then control the process of making such tools to significantly enhance performance and reliability. As will be readily understood from the following disclosure, not only is it possible to observe in such surveys the desirable levels of bonding alloy and diamond individually, but through statistical methods it is possible to discover interactions between the amounts of diamond and bonding alloy applied that may lead to more consistent and superior performance. Employing more precise control of the applied amounts of these materials provides dramatic improvement and consistency of performance of resulting commercially fabricated tools in accordance with practicing the method of the present invention.

DETAILED DESCRIPTION

In the braze bonding of superabrasive particles, such as diamond and cubic boron nitride for example, to an abrasive tool substrate or blank form, the typical process steps include applying a coating of the bonding alloy and a monolayer of the abrasive particles to the substrate to form a tool assembly which is introduced to a furnace under suitable conditions to melt the bonding alloy to secure the abrasive to the substrate.

Generally it has been known that the bond depth and abrasive concentration are important to provide a quality tool for abrasive grinding, cutting, or polishing operations. Various manufacturers of brazed tooling of this kind have known that the quantity of bonding alloy and abrasive particles are an important consideration in providing a high quality abrasive tool and have developed techniques to attempt to control the amount of alloy and diamond applied to the tool substrate by trial and error using visual inspection methods of finished product. However, we have recently discovered that commercially acceptable appearing tools have proven to be more inconsistent in performance than is desirable. The breadth of the range of inconsistency of tool performance of commercially produced tools which have passed visual quality control methods has heretofore not been quantified to any significant extent. It has been discovered that in many of such tools, visual inspection failed to show any significant difference between tools which later testing showed did not perform substantially the same with respect to cutting rates or durability.

Investigative tests were instituted which included a very precise tare weighing of the individual amounts of alloy and diamond actually applied to the tool and revealed that very modest differences in the weight of alloy and diamond applied, in fact, had a surprisingly significant effect on cutting rate performance over the useful life of the tool. Further, these modest differences were too small to be revealed in even the most rigid visual inspection of the partially assembled tool or the finished tool.

Subsequent investigation revealed that different abrasive tool shapes and given abrasive applications can require different loading requirements relative to the amount of alloy and diamond applied to achieve the most desirable tool performance within relatively very close tolerances.

Based upon these discoveries, and in accordance with the present invention, a novel method of fabricating a monolayer abrasive tool was developed which includes a weight determination of the amount of bonding alloy and diamond particles applied to the tool substrate which is compared to an established target weight for each material. If the amount of alloy or diamond applied fails to meet this standard, the partially assembled tool may be rejected and the mandrel, alloy bonding material and diamond abrasive may be recovered and recycled in the manufacturing process.

It has also been established that operators which manually apply the alloy and diamond particles to the substrate using the conventional dipping or sprinkling technique can quickly adapt to providing dramatically improved and consistent results when given the appropriate feedback of the weight information derived after each step of applying the alloy or the diamond to the tool substrate.

With a relatively short training period, experienced assembly personnel have learned to adapt to the weight feedback information to achieve a very acceptable low percentage of rejects. Further, unlike the prior visual inspection of the finished tool, unfinished tools rejected using the method of the present invention permit the saving of the tool mandrel, alloy and diamond abrasive particles which can be reclaimed and recycled in an economical manner.

It has also been found that the more precise control of the amounts of alloy and diamond as well as the ratio of each to one another within relatively small limits can provide a surprising degree of improvement in the performance characteristics of the tool, such as faster stock removal and durability for example. Therefore, better performing monolayer abrasive tools may be more consistently fabricated according to the method of the present invention in a very practical and economic manner.

In accordance with the preferred embodiment of the present invention, desired weight limits relative to a target weight for the alloy and the abrasive particles are preferably selected which provide the bond height and abrasive concentration which result in improved performance characteristics such as cutting rate and longer useful life.

While there is some controversy in the industry regarding standards for testing of performance characteristics of monolayer abrasive tools and particularly as related to rotary monolayer diamond dental tools, it is believed that the performance of brazed tools of this type can be reliably tested using natural tooth material from extracted and preserved teeth or a surrogate material such as glass. Our testing has verified that the modes of wear of brazed monolayer diamond tools are substantially identical in glass and natural teeth and therefore reliable performance test information can be obtained using either media for stock removal and durability testing. It may be preferred to employ the same material and conditions as the tool will encounter in actual commercial usage to obtain the most accurate performance data. However, acceptable surrogates can be found, where practical, to provide sufficiently reliable information to improve the consistency of fabricating better performing tools using the method of the present invention.

Blind studies were conducted as described later herein wherein tare weight determinations of the amount of braze alloy and diamond applied were made and not provided to the fabricating personnel operating under the conventional processing standards. Then another group of tools were made wherein the weight information was provided to the fabricating personnel. The consistency of the weight of alloy and diamond applied were dramatically improved in the second group of tools. This showed that using the weight monitoring and feed back technique as disclosed herein can aid operating personnel to better control the fabrication process as compared to prior methods.

By using performance testing of a range of the measured amount of alloy and diamond applied to the tool, a suitable weight target may be selected as related to selected performance characteristics to enable a very high percentage of tools to be fabricated which meet these performance characteristics compared to the relatively wide range of fluctuation in performance characteristics observed using conventional methods.

Whatever performance test regimen is chosen to select target weight information, the method of the present invention permits fabrication of brazed monolayer abrasive tools in a consistently more reliable manner to meet performance characteristics related to the selected weight targets. By appropriately choosing reasonably reliable target weights related to performance, one can readily appreciate the improvement in the quality of the tools which are passed for complete processing to a finished product.

Therefore, a suitable number of identical tool shapes may be made using a selected range of the applied weights of alloy and diamond applied and tested for performance as referred to above to establish the most desirable weight standards to achieve the selected level of performance.

Using this weight standard in the commercial production of such tools as described herein then provides a much higher percentage of tools exhibiting consistently higher performance than that capable using prior art methods.

While the method of the present invention includes a manufacturing method wherein alloy and diamond are applied to a single tool and a weight determination is based on that one tool, it has been found that highly successful results can be obtained using the average weight of a selected group of tools to speed up the production process. For example, a fixture for multiple tool mandrels may be initially weighed and then weighed with the mandrels to establish a tare weight and an average weight of a single tool mandrel in the group. Then, alloy may be applied using either a dipping or sprinkling technique, for example, to each of the selected tools prior to again tare weighing the whole group and establishing an average weight of the alloy applied to each individual tool substrate. This average weight determination may then be compared to the established weight standard.

This same procedure is continued for application of the diamond particles over the alloy, assuming the group of tool substrates carrying the applied alloy particles is within the selected weight standard. Again, the average weight of diamond applied per tool is compared to the selected standard weight for the amount of diamond particles applied before the group of tool assemblies passing this comparison test are delivered to the brazing furnace to complete the fusion step of the process.

Alternatively, it has also been found that merely comparing the total weight of the group after each step against a standard weight for the same number of tools after each application step also provides sufficient consistency and reliability to produce very significant improvements in the performance characteristics desired.

It is believed that the weighing and comparing steps can also be periodically used in a production line assembly as the operators become more experienced. It is possible that the frequency of the weighing and comparing steps can be reliably determined using statistical process control analysis such that several tool groups can be fabricated without the weighing and comparing steps before a periodic weight monitoring check is made to determine that the quality standards are indeed being met. Therefore, for purposes of the present invention, the method of making the weight determination of the braze alloy and abrasive particles applied includes either a weighing of a single tool, weighing of a selected group of tools, or the periodic weighing of a single tool or group of tools being made in a production line process as may be determined by statistical process control method analysis to be sufficient to provide reliable control over the involved processing steps to assure suitable control of the amount of braze alloy and diamond being applied is attained.

The following examples illustrate preferred embodiments of the present invention.

EXAMPLE I

A round tapered diamond abrasive dental instrument for use in a rotary hand held drill having an abrasive head 9 mm long was manufactured in a significant quantity of approximately 1800 units using the conventional methods involving manual application using a temporary binder of an amount of the brazing alloy and diamond particles to a stainless steel dental tool mandrel having the selected form. The braze used was a Ni,Cr,B brazing alloy readily available commercially. However, after each application step of the brazing alloy powder, the weight of the braze alloy powder applied to the tools was determined before the diamond particles were applied. The same weight determination procedure was followed after the application of the diamond particles so that the applied weights of braze powder and diamond were known. However, these weight determinations were not revealed to the fabricating personnel applying the braze powder and diamond particles.

The weight of braze powder actually applied to this group of instruments ranged from approximately 0.0118 grams to 0.0134 grams per instrument. The weight of diamond in the form of 120/140 mesh natural blocky grit, ranged from 0.0064 grams to 0.0080 grams per instrument. All the tools were brazed to complete the manufacture under the same conditions used for commercially sold tools of the type available from Abrasive Technology, Inc. of Westerville, Ohio generally in accordance to the method disclosed in U.S. Pat. No. 3,894,673.

Within this group of instruments, several were selected which visually appeared identical at up to 40 × magnification with regard to bonding depth and diamond concentration but which actually represented approximately a 10% variation in alloy weight and an 18% variation in diamond weight based upon the weight information gathered during their fabrication. Five instruments were selected randomly from those representing each corner of this range in weight variation and tested employing normal test parameters using glass as the work material: a hand piece generating 400,000 rpm, water spray at the rate of 10 ml/min; and 100 gram loading pressure.

The instruments representing the high alloy, low diamond corner of the weight range exhibited cutting rates ranging from 0.036 to 0.071 inches/sec. The instruments representing the low alloy, low diamond corner of the weight range performed at a higher cutting rate ranging from 0.073 to 0.092 inches/sec.

The lack of overlap of these cutting rate performances is significant statistically for this small sample size of five. At the same time, the low alloy, low diamond group demonstrated an average useful life 100% greater than the high alloy, low diamond group based on cutting glass with each instrument until the same predetermined end of life cutting rate was attained.

This test strongly indicated that visual inspection of the tools for bond depth and diamond concentration after brazing which were fabricated using the same manufacturing specification guidelines for manual application of the braze and diamond is not capable of sufficient control of these parameters in the finished tools to provide a high degree of consistent tool performance, contrary to prior beliefs and practices in this field.

EXAMPLE II

In a separate test, an individual experienced in fabrication of dental instruments and applying the braze powder and diamond grit to stainless steel dental tool mandrels of the same form as in Example I and using the same manufacturing techniques as in Example I was monitored over a period of several days by making weight determinations of the amount of braze alloy and diamond applied in a significant number of randomly selected tool constructions without giving this information to the individual fabricating the instruments.

Surprisingly, the braze alloy weight range was from 0.0105 to 0.0178 grams per instrument from those specimens randomly selected. The diamond weight of these specimens ranged from 0.0022 to 0.0106 grams per instrument. It was quite clear that the finished product made from these specimens after fusion of the bonding alloy would exhibit an appearance causing a significant number of rejects under the same visual inspection used in Example I and result in a significant loss of the tool components of the rejects.

This same individual was again monitored over a similar period by using the same weight determination steps, however, the weight information and direction of deviation from a target weight was immediately given to the individual after each application step.

Using this weight feedback system over several days, instrument assemblies produced by this individual over this period showed an alloy weight variation in the range of 0.0135 to 0.0142 grams per instrument and a diamond range of 0.0064 to 0.0074 grams per instrument. This represents approximately a 5% alloy weight variation and a 13% diamond weight variation which is significantly reduced compared to variations found when no weight information was provided to the individual fabricating the instruments.

This strongly evidenced that operating personnel can quickly learn to adjust the application of braze alloy and diamond to dramatically improve the consistency of the amounts applied and hold these amounts within very close tolerances related to a target weight using the method of the present invention.

Additionally, the weight information derived during the actual fabrication of the tools detects those tool assemblies which fail to meet the target weight and can be rejected prior to committing the tool assembly to the fusion step. The components of the rejected tool assemblies may then be recovered and re-cycled at a considerable savings in materials. This important advantage over the prior art practice of inspecting the finished tool is independent of whether or not the weight determination information is provided to the fabricators applying the braze alloy and diamond particles. Providing monitored weight determinations to the fabricators tends to lower the percentage of rejects at each applicable step and therefore advantageously improves the efficiency of the fabrication process in this regard. The weight monitoring represents the control of the process which assures that only those tool assemblies possessing the amount of braze alloy and diamond meeting the selected target weight will be further processed to a finished tool.

Based upon other extensive testing, it was shown that using a weight monitoring system and selected target weights and feeding this information back to the individuals applying the braze and diamond to the tool substrate form produced dramatically improved consistency to the fabricating process of the brazed abrasive tooling. Employing the weight determinations in accordance with the present invention and a suitable testing procedure to determine target weights for the alloy and diamond applied to establish the most desirable performance characteristics provides a significant advance in making a more consistently high performing abrasive tool than possible using prior methods and means.

It is particularly surprising and unexpected that what appeared to be insignificant differences in the amount of braze alloy and diamond applied to such brazed tools can lead to the very dramatic differences in the tool's performance characteristics. Prior to the present invention, the significant effect of such relatively small differences was not recognized by those skilled in the art.

It is believed that testing to determine the weight target to be selected for the braze and diamond applied should be done for all significant variations in abrasive head configuration or for different abrasive tool applications in order to obtain tools possessing the most improved performance characteristics. Once the target weights are established, the method of making the tools according to the present invention will provide a significantly improved consistency in performance of the finished tool product.

Further, it is believed that the method of controlling the fabrication process in accordance with the present invention will permit a significant reduction of labor costs related to visual inspection personnel previously used to inspect bond height and diamond concentration.

It should also be noted that while the method of the present invention was described relative to using manual application of the braze alloy and abrasive to the tool substrate, it also includes and contemplates the use of automation, such as robots or other forms which may be developed, for the steps of applying these materials to a tool and represents a method by which such techniques can be more rapidly developed and employed. The use of statistical process control analysis would likely be particularly applicable in such automated processing steps.

We claim:

1. In a method for making braze monolayer abrasive tools performing the steps of:

a) applying braze alloy particles to an abrasive tool blank form;

b) making a weight determination of the braze alloy particles applied to said blank form;

c) comparing the weight of the braze alloy particles determined in step (b) to a first weight target and determining if the weight of the braze alloy particles meets the first weight target;

d) applying a monolayer of superabrasive particles to the blank form if said comparison determination is positive to form a tool assembly;

e) making a weight determination of the superabrasive particles applied in step (d);

f) comparing the weight of the superabrasive particles determined in step (e) to a second weight target and determining if the weight of the superabrasive particles meets said second weight target; and g) placing said tool assembly in a brazing atmosphere to cause said braze alloy to melt and bond said superabrasive particles to said tool blank form if the comparison determination in step (f) is positive.

2. A brazing method of making a monolayer superabrasive tool comprising the steps of:

a) making a weight determination of one or more abrasive tool blank forms;

b) applying alloy bonding particles to said one or more said tool blank forms using a temporary binder;

c) making a weight determination of the alloy bonding particles applied to each of the tool blank forms in step (b);

d) comparing the weight of alloy bonding particles as determined in step (c) to a first selected weight target;

e) applying a monolayer of particles of a superabrasive to the one or more tool blank forms possessing a weight of alloy bonding particles determined to meet the selected weight target in step (d) using a temporary binder to form a tool assembly for each of said one or more tool blank forms;

f) making a weight determination of the diamond particles applied to each of the one or more tool blank forms in step (e);

g) comparing the weight of the superabrasive particles determined in step (f) to a second selected weight target; and h) placing the one or more tool assemblies determined in step (g) to possess an amount of superabrasive particles meeting the selected weight target in a brazing atmosphere to cause said alloy bonding particles to melt and bond said superabrasive particles to a respective one of said tool assemblies.

3. A brazing method of making monolayer superabrasive tools comprising the steps of:

a) determining the average weight of a selected number of tool blank forms comprising a predetermined group of blank forms;

b) applying alloy bonding particles to each tool blank form in said predetermined group using a temporary binder;

c) determining the average weight of alloy bonding particles applied to each of the tool blank forms in said group;

d) comparing the average weight of alloy bonding particles determined in step (c) to a first selected weight target;

e) applying a monolayer of particles of a superabrasive to each tool blank in said group using a temporary binder if said weight average of alloy particles determined in step (c) meets the first selected weight target compared in step (d) to form a separate tool assembly for each tool blank form in said group;

f) determining the average weight of diamond particles applied to each tool assemblies formed in step (e);

g) comparing the average weight of the superabrasive particles determined in step (f) to a second selected weight target; and h) placing the group of tool assemblies in a brazing atmosphere to melt said alloy bonding particles and bond said superabrasive particles applied to a respective one of said tool assemblies if said average weight of abrasive particles determined in step (f) favorably compares to the second selected weight target.

* * * * *